US005108190A

United States Patent [19]

Benthimer et al.

[11] Patent Number: 5,108,190

[45] Date of Patent: Apr. 28, 1992

[54] ROTARY MIXER AND CONVEYOR SYSTEM

[75] Inventors: Floyd D. Benthimer, Streetsboro; Stanford Pollack, Garfield Hts., both of Ohio

[73] Assignee: FECO Engineered Systems, Inc., Cleveland, Ohio

[21] Appl. No.: 674,658

[22] Filed: Mar. 25, 1991

[51] Int. Cl.[5] ..... B01F 11/00

[52] U.S. Cl. ..... 366/214; 366/216

[58] Field of Search ..... 366/208, 218, 209, 210, 366/211, 213, 214, 215, 216, 217, 219, 220, 235; 99/348

[56] References Cited

U.S. PATENT DOCUMENTS 965,802 7/1910 Flounders ..... 366/218
2,514,680 7/1950 Stafford ..... 366/213
2,542,451 2/1951 Anderson ..... 366/218

*Primary Examiner*—Robert W. Jenkins
*Attorney, Agent, or Firm*—Renner, Otto, Boisselle & Sklar

[57] ABSTRACT

A rotary mixer and conveyor system wherein the containers are automatically processed through a rotary mixer. The rotary mixer is of a simple and reliable design which lends itself to each integration into new or existing conveyor lines. The rotary mixer is operative to engage and rotate simultaneously a plurality of containers end over end to effect mixing of the contents of the closed containers. The containers are fed automatically by a conveyor to a pick-up area in the rotary mixer where the containers are automatically engaged and rotated and then redeposited on the conveyor for automatic transfer out of the rotary mixer.

20 Claims, 3 Drawing Sheets

ROTARY MIXER AND CONVEYOR SYSTEM

The invention herein described relates generally to a rotary mixer and conveyor system wherein containers such as cans are rotated end over end to effect mixing of the contents of the containers and, more particularly, to such a system and associated method wherein loading and unloading of the rotary mixer can be performed automatically.

BACKGROUND OF THE INVENTION

From time to time there arises a need to effect mixing of the contents of containers such as cans and, in particular, aerosol cans. This mixing may be desired, for example, soon after the containers have been filled by filling equipment in a production line wherein the containers are conveyed by conveyors through various stations including a filling station as well as other stations such as, for example, a coating station, capping station, labelling station, etc. One technique for mixing the contents of the closed containers has been to manually shake the container or turn the container end over end. Also known is a rotary mixing device wherein the containers are manually loaded into a cradle which is then driven by a motor to rotate the containers end over end. The containers are held in the cradle in two rows parallel and symmetric to the rotational axis of the cradle. This mixing device, however, is only semi-automatic in that the containers must be manually loaded into and unloaded from the cradle.

SUMMARY OF THE INVENTION

The present invention provides a rotary mixer and conveyor system wherein the containers are automatically processed through a rotary mixer. The rotary mixer is of a simple and reliable design which lends itself to easy integration into new or existing conveyor lines. The rotary mixer is operative to engage and rotate simultaneously a plurality of continers end over end to effect mixing of the contents of the closed containers. The containers are fed automatically by a conveyor to a pick-up area in the rotary mixer where the containers are automatically engaged and rotated and then redeposited on the conveyor for automatic transfer out of the rotary mixer.

In accordance with the invention, the rotary mixer comprises a clamp including opposed clamp jaws relatively moveable towards one another simultaneously to clamp therebetween a plurality of containers and away from one another to release the containers, and clamp actuator means for effecting such relative movement of the clamp jaws to open and close the clamp; means for moving the clamp relative to the conveyor transversely in relation to a rotate axis to locate the containers clamped between the clamp jaws clear of the conveyor; and means for rotating the clamp about the rotate axis with the containers clamped between the clamp jaws and located clear of the conveyor.

In a preferred embodiment of the invention, the rotary mixer comprises a main frame, and the means for moving includes an elevator carriage mounted to the main frame for vertical movement and means for vertically raising and lowering the elevator frame. The clamp includes a rotate frame rotatably carried by the elevator carriage and the opposed clamp jaws are mounted to the rotate frame for relative movement towards and away from one another. As is preferred, the clamp actuator means includes pistoncylinder assemblies connected between the clamp jaws and the rotate frame, and the clamp jaws are elongated in a direction parallel to the rotate axis for clamping therebetween a row of containers. Provision is made for automatically feeding a row of containers to the pick-up area along the conveyor, and the clamp jaws are operable to clamp the row of containers therebetween. Provision also is made for automatically feeding the row of containers out of the rotary mixer after the containers have been deposited on the conveyor by the clamp.

According to another aspect of the invention, there is provided a method for simultaneously rotating a plurality of containers to effect mixing of the contents thereof. The method comprises the steps of positioning opposed clamp jaws at respective sides of a plurality of containers at a pick-up area along a conveyor; closing the clamp jaws simultaneously to clamp therebetween the plurality of containers; moving the closed clamp jaws away from the conveyor so that the containers are clear of the conveyor; rotating the clamp jaws about a rotate axis to rotate the containers clamped therebetween; and then returning the containers to the conveyor and opening the clamp jaws to release the containers. Preferably the method comprises the step of positioning the containers in a row at the pick-up area along the conveyor, and the closing step includes clamping the row of containers between the clamp jaws, and the rotating step includes rotating the containers about a rotate axis parallel to the row of containers.

The foregoing and other features of the invention are hereinafter fully described and particularly pointed out in the claims, the following description and the annexed drawings setting forth in detail a certain illustrative embodiment of the invention, this being indicative, however, of but one of the various ways in which the principles of the invention may be employed.

DETAILED DESCRIPTION

Figure 1:
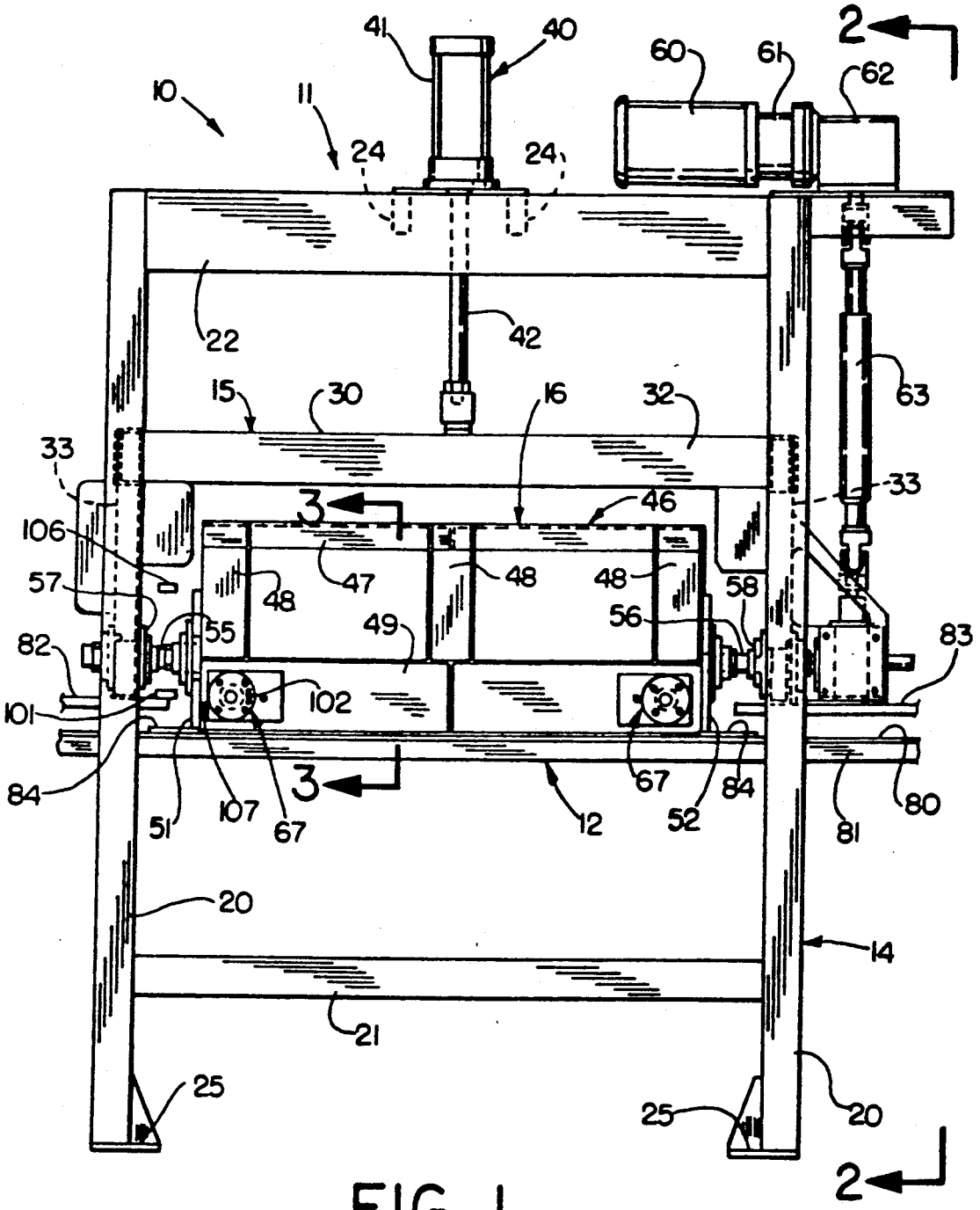
FIG. 1 is a side elevational view of a rotary mixer and conveyor system according to the invention.
Figure 2:
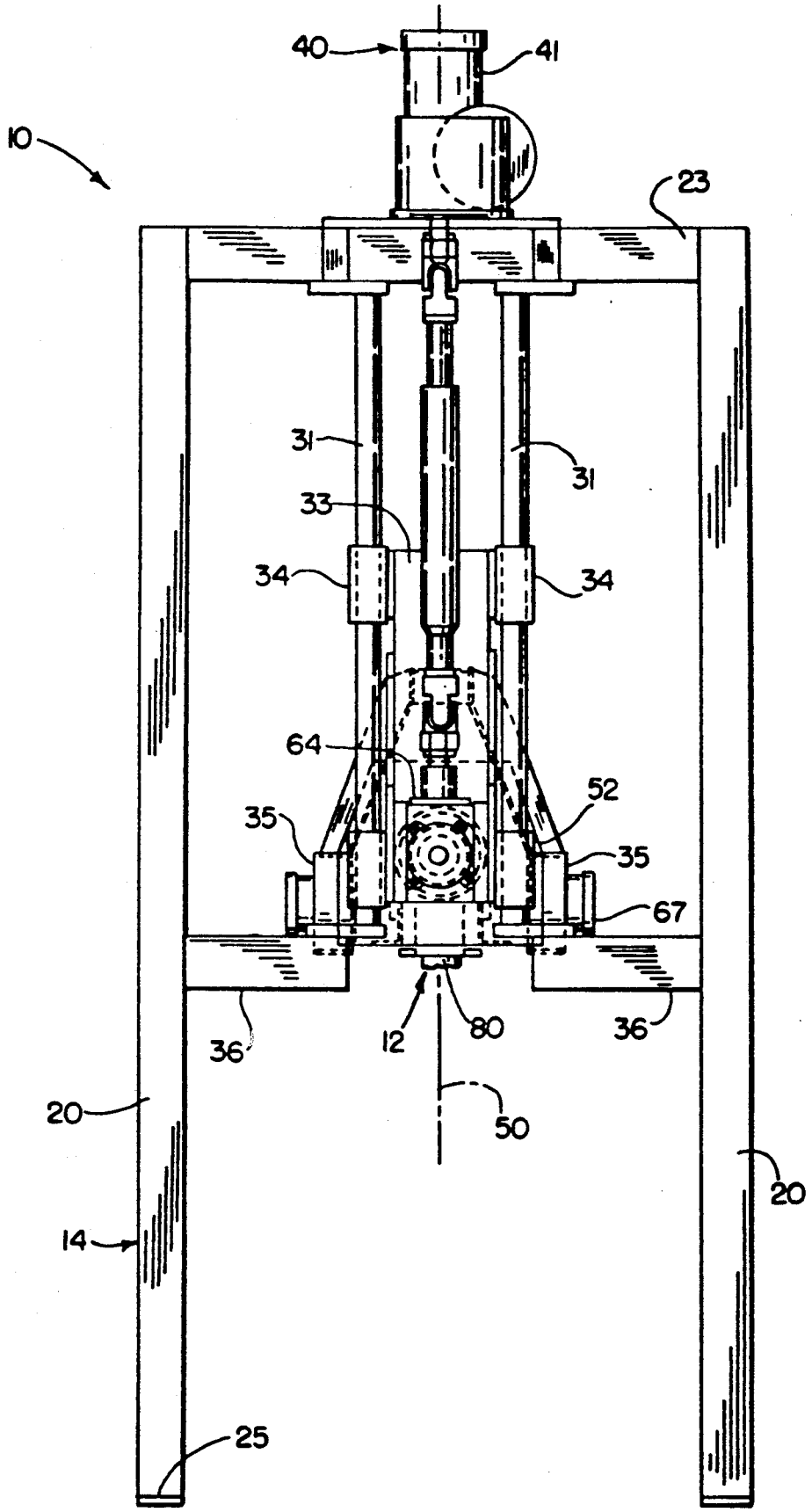
FIG. 2 is an end elevational view of the system of FIG. 1, looking from the line 2—2 of FIG. 1.

Referring now in detail to the drawings and initially FIGS. 1 and 2, a rotary mixer and conveyor system according to the invention is indicated generally at 10. The system 10 comprises a rotary mixer 11 and a conveyor 12 for conveying containers such as cans to and from the rotary mixer. The rotary mixer is operative to rotate simultaneously a plurality of containers end over end to effect mixing of the contents of the containers.

The rotary mixer 11 generally comprises a support structure 14, an elevator carriage 15 mounted to the support structure 14 for vertical movement and a rotate frame and clamp assembly 16 mounted to the carriage 15 for rotation about an axis parallel to the conveyor. Each of these major components of the rotary mixer and their respective actuators are described below in relation to the illustrated preferred embodiment of rotary mixer designed to rotate containers and more particularly cans that are conveyed upright by the conveyor to the rotary mixer, such as after they have been filled by filling equipment located upstream of the rotary mixer in a production line. Details of the rotary mixer and conveyor not germane to the invention have not been shown in the drawings so as not to distract the reader from gaining an understanding of the invention and its underlying principles.

The support structure 14 in the illustrated embodiment is in the form of a floor mounted frame which straddles the conveyor 12. The frame 14 (also herein referred to as the main frame) includes at each side of the conveyor a pair of legs 20 which are joined together near their lower ends by a longitudinally extending leg brace 21 and at their upper ends by a longitudinally top beam 22. The legs at each end of the frame also are joined together at their upper ends by a transversely extending crossbeam 23. The frame 14 also includes center top beams 24 extending transversely between the crossbeams 23. Adjustable feet or footers 25 of any suitable type may be provided at the lower ends of the legs 20 for mounting the frame to the floor 26 and for adjusting machine height.

The elevator carriage 15 includes a yoke-like carriage frame 30 which is guided for vertical movement by vertical guide rods 31 mounted to the main frame 14. The carriage frame 30 includes a longitudinally extending beam 32 which is joined at its ends to respective vertical end frame members 33. Each end frame member 33 has secured to each side thereof an upper rod sleeve 34 and a lower rod sleeve 35 through which a respective one of the guide rods 31 extends. The rod sleeves 34 and 35 may be fitted with linear bearings, such as sleeve bearings, for smooth guided movement along the guide rods 31. The guide rods 31, which are arranged in pairs at respective ends of the elevator carriage, are mounted at their upper ends to the cross-beam 23 and at their lower ends to respective lower rod mounts 36. The lower rod mounts are mounted to respective legs 20 of the main frame 14, and the guide rods 31 and the lower rod mounts 36 at each end of the elevator carriage 15 are transversely spaced apart a sufficient distance to allow passage therebetween of the containers conveyed by the conveyor 12 as best seen in FIG. 2.

The elevator carriage 15 is vertically raised and lowered by an actuator 40 which in the illustrated embodiment is a pneumatic cylinder assembly. The cylinder 41 of the cylinder assembly 40 is mounted to the center top beams 24 at its midpoint. The rod 42 of the cylinder assembly 41 extends downwardly for connection to the elevator carriage at the midpoint of the beam 32. As will be appreciated, retraction and extension of the cylinder assembly 40 will effect raising and lowering of the elevator carriage, respectively. During this vertical movement the elevator carriage carries with it the rotate frame and clamp assembly 16.

The rotate frame and clamp assembly 16 comprises a rotate frame 46 which in the illustrated embodiment includes a longitudinally extending central spine 47 from which three pairs of legs 48 depend. The pairs of legs are located respectively at the ends and center of the spine with the legs of each pair extending downwardly and outwardly from opposite sides of the spine. The lower ends of the legs at opposite sides of the rotate frame are secured to respective longitudinally extending side frame members 49. The side frame members 49 are parallel and symmetrically off-set from a vertical center plane 50 through the rotary mixer 12.

The side frame members 49 are secured at their ends to end plates 51 and 52 respectively disposed at the entrance and exit ends of the rotate frame 46. The end plates 51 and 52 are secured by respective hubs 53 and 54 to the inner ends of respective shafts 55 and 56 which extend longtudinally outwardly from the ends of the rotate carriage frame. The shafts are journaled for rotation in bearings 57 and 58 mounted to the elevator carriage frame 30. In this manner the rotate frame 46 is mounted to the elevator carriage 13 for raising and lowering therewith while being rotatable about an axis extending parallel to the conveyor 12.

The rotate frame 46 is rotated by a motor 60 which in the illustrated embodiment is a 90 Volt DC motor. The motor is coupled by a clutch/brake device 61 to a speed reducer 62 which is connected to one end of a telescoping spline shaft 63. The other end of the spline shaft 63 is connected to a right angle gear box 64 which is connected to the rotate frame shaft 56. The telescoping spline shaft allows for raising and lowering of the rotate frame during raising and lowering of the elevator in that the speed reducer 62 and gear box 64 are respectively mounted to the main frame 14 and elevator carriage frame 30. A counterweight 59 is mounted to the end of the carriage frame 30 opposite the gear box 64 to counter-balance the weight of the gear box and associated mounting brackets.

The major frame components of the elevator carriage and rotate frame preferably are made of a strong but lightweight material such as aluminum, thereby to reduce the mass of the major moving parts of the rotary mixer.

In addition to the rotate frame the rotate frame and clamp assembly 16 further comprises a clamp 65. With additional reference to FIG. 3 the clamp 65 comprises a pair of oppositely disposed clamp jaws 66 symmetrically located on opposite sides of the vertical center plane 50 through the rotary mixer. Each clamp jaw 66 is mounted by a pair of pneumatic cylinder assemblies 67 to a respective one of the side frame members 49 of the rotate frame 46 for movement towards and away from the other clamp jaw and laterally in relation to the conveyor 12. The pneumatic cylinder assemblies 67 also function as actuators for effecting such movement of the clamp jaw. The cylinders 68 of the cylinder assemblies 67 are mounted to the side frame member 49 in direct opposition to the cylinders of the cylinder assemblies at the other side of the rotate frame as is preferred for balanced application of force to a row of containers clamped between the clamp jaws.

Each clamp jaw 66 includes a clamp pad 72 attached to a longitudinally extending pad mount 73. The pad mount 73 is secured at opposite ends thereof to the rods 74 of the cylinder assemblies 67. As is preferred, such securement is effected by removable fasteners to enable quick and easy replacement with clamp jaws of different sizes and/or shapes for use with containers of different sizes and/or shapes.

Figure 3:
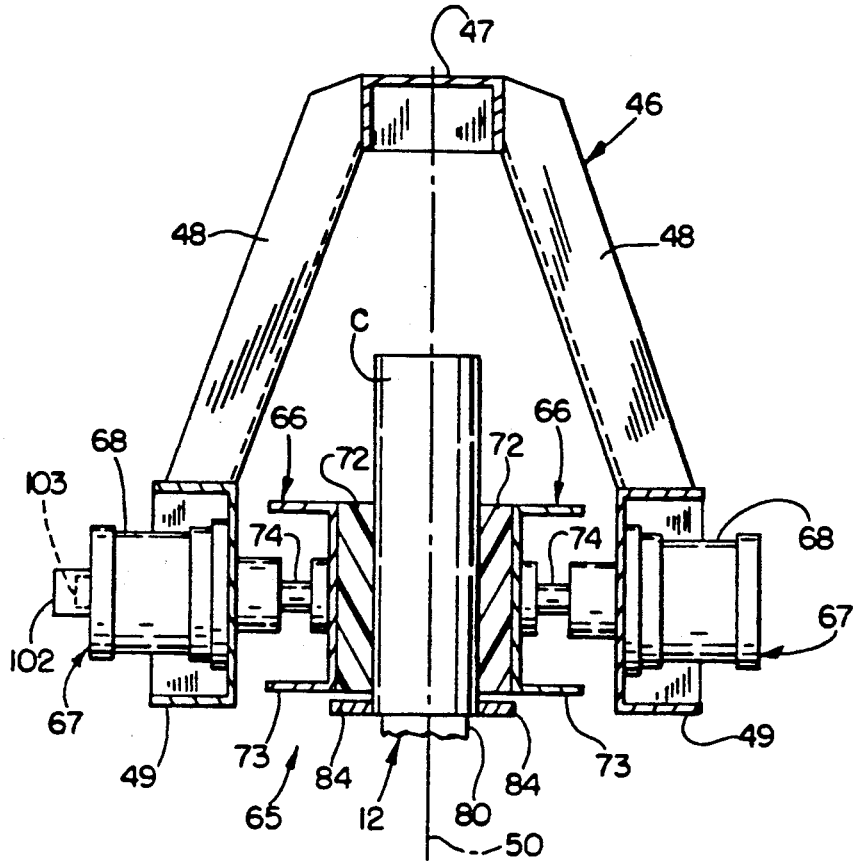
FIG. 3 is a transverse sectional view through a portion of the system of FIG. 1, taken along the line 3—3 of FIG. 1.

As seen in FIG. 3, the clamp cylinder assemblies 67 may be extended to grip between the clamp jaws 66 a container C that has been moved therebetween by the conveyor 12. As will be appreciated, a row of containers of like diameter or transverse dimension can be gripped simultaneously between the clamp jaws. The clamp pads 72 should be made of a material that is sufficiently resilient to accommodate anticipated tolerance differences in the diameters or transverse dimensions of the containers. On the other hand, the clamp pads should be of sufficiently rigid material to hold the containers in position during rotation of the rotate carriage.

In the illustrated embodiment each clamp pad 72 is a one inch thick, five inch wide block of polyurethane of about 60 Durometer on the D scale. This clamp pad is particularly suited for use with pressurized cans. However, the material and hardness of the clamp pad may be varied as desired for different applications and performance requirements.

Containers are delivered by the conveyor 12 to the rotary mixer 11 for gripping by the clamp 65. The conveyor in the illustrated embodiment includes an endless conveyor chain 80 which slides in a track 81. The chain 80 preferably is continuously driven left to right in FIG. 1 by a conventional drive (not shown) while the flow of containers in and out of the rotary mixer is managed by gates. The containers are transported upright by the conveyor which is equipped with entrance and exit guide rails 82 and 83 for single file delivery and exiting of the containers to and from the rotary mixer. The entrance and exit guide rails terminate short of respective ends of the rotate frame 46. In order to guide the containers along the conveyor in the gap between the entrance and exit guide rails, guide bars 84 are mounted at respective sides of the conveyor belt 80. As best seen in FIG. 3 the guide bars are positioned to clear the lower edges of the clamp jaws 66 when the clamp jaws are moved inwardly to engage the containers supported on the conveyor.

Figure 4:
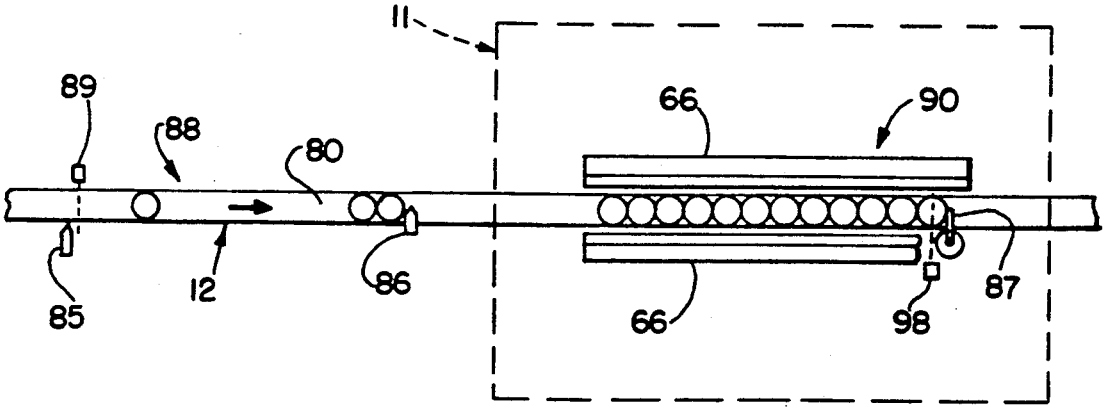
FIG. 4 is a schematic plan view illustrating container flow control components of the system.

In the illustrated embodiment and as shown in FIG. 4, three gates 85, 86 and 87 are used to manage the flow of containers in and out of the rotary mixer. The gates 85 and 86 are located at the upstream and downstream ends of a batch accumulating area 88 of the conveyor 12. The gates 85 and 86 are each of conventional type including a stop arm which may be extended from an ambush position to a blocking position which prevents a container from being moved by the moving conveyor belt past the gate. The stop arm may be returned to its ambush position which allows containers to pass thereby.

The third gate 87 is located at the downstream end of a pick-up/clamping area 88 of the conveyor. The gate 87 preferably comprises a stop arm mounted to the shaft of a rotating air cylinder. The stop arm is swung by the rotating air cylinder between a stop position extending across the container path to an ambush position where the stop bar is parallel to the container path and at a lower elevation to avoid interference with the rotate frame and clamp assembly 16 when positioned to engage the containers in the hereinafter described manner.

Operation of the rotary mixer and conveyor system 10, and related controls, will now be described with initial reference being had to FIG. 4. In FIG. 4, the conveyor 12 moves the containers from left to right. Containers may be received from other equipment located upstream in a production line such as container filling equipment. System operation may be controlled by any suitable controller such as, for example, a programmable controller. The controller is interfaced in conventional manner to the various actuators and sensors herein discussed to control operation of the system. The hereinafter mentioned sensors may be of any type suitable for carrying out the stated control function of the sensor.

Initially the gate 86 will be closed to accumulate a batch of containers, i.e., a preselected number of containers. A first container will engage and be stopped by the gate 86 after which additional containers will back-up behind the first container and form a row of containers. The containers passing into the accumulator area preferably are counted by a sensor 89. The sensor 89 enables determination of when a predetermined number or batch of containers has been accumulated behind the gate 86. After a batch of containers has been accumulated the gate 85 may be closed to block entry of any additional containers into the accumulator area 88 until after the batch of containers has been fed into the rotary mixer 11.

Referring now to the sequence of operation of the rotary mixer 11, initially the elevator carriage 15 is in its raised or up position and the rotate frame 46 is in its home position with the clamp 65 open. The gate 86 is opened to allow the accumulated batch of containers to be fed single file by the conveyor 12 into the rotary mixer until the leading container of the batch engages and is stopped by the then closed gate 87. The gate 87 positions the batch or row of containers at a pick-up/clamping area 90 of the conveyor. The pick-up/clamping area 90 of the conveyor is a straight horizontal section of the conveyor which coincides with the opposed clamp jaws 66 of the clamp 65. As the containers move into the rotary mixer the leading container is detected by a sensor 98 located just before the gate 87. The sensor 98 provides an indication that the containers have left the accumulator area 88 and are positioned in the clamping area 90. At this point the gate 86 may be closed and the gate 85 may be opened to allow for accumulation of a new batch of containers in the accumulator area during the mixing cycle.

With a batch of containers loaded into the rotary mixer and held in place by the gate 87 as illustrated in FIG. 4, the elevator carriage 15 is lowered to position the clamp jaws 66 at opposite sides of the row of containers. The down position of the elevator carriage may be detected by a suitable limit switch (not shown). When the elevator carriage is in its down position the clamp jaws are closed, i.e., moved towards one another, to clamp and firmly hold the row of containers therebetween. Extension of the clamp jaw cylinder assemblies 67 is confirmed by a sensor (schematically indicated at 101 in FIG. 1) such as an electric eye which directs a beam of light for reflection by a reflector (schematically indicated at 102) strategically mounted on the rotate frame 46. When the clamp jaws are open the beam is interrupted by a rearwardly extending rod end or rod extension 103 (FIG. 3) of the cylinder assembly 67 nearest the sensor 101. When the cylinder assemblies are extended the rod end 103 moves out of the path of the beam of the sensor 101 which then informs the controller that the clamp jaws have been closed to grip the containers.

With the containers firmly held by the clamp 65, the elevator carriage 15 is raised to its up position to move the containers clear of the conveyor 12. The up position of the elevator carriage may be detected by a suitable limit switch (not shown).

At this point, the rotate frame and clamp assembly 16 is rotated to turn the containers end-over-end to effect mixing of the contents thereof. Rotation is effected by engaging the clutch 61 which couples the motor 60 to the drive components 62–64 connected to the rotate frame 46. A suitable motor controller may be provided to control and vary the motor speed which in turn controls the rotational speed of the rotate frame. The rotate axis preferably passes through the containers held in the clamp.

The speed at which the rotate frame 46 is rotated and the length of time or number of revolutions may be varied as desired for different applications. To effect mixing the rotational speed normally should be slow enough so as to allow gravity to effect movement of the contents of the containers as they are turned end-over-end. If the containers are rotated too fast, centrifugal forces might act to minimize any mixing action within the containers. However, some applications may take advantage of the centrifugal forces that are developed at higher rotational speeds.

The containers may be rotated for a predetermined period of time or for a predetermined number of revolutions. In the latter case, another electric eye (schematically indicated at 106) and a reflector (schematically indicated at 107) on the rotate frame 46 may be used to count the number of revolutions, there being issued one count signal to the system controller for each time the light beam is reflected back to the electric eye 106. The electric eye 106 emits a beam of light which is reflected by the reflector 107 positioned on the rotate frame to be in line with the beam when the elevator is in its up position.

After the predetermined number of revolutions or prescribed amount of time, rotation of the rotate frame 46 is stopped such that the rotate frame is located in its home position. Stopping of the rotate frame may be effected by engaging the brake and disengaging the clutch of the clutch/brake 61. More particularly, the brake may be engaged momentarily while the motor controller decreases the motor speed after the next to the last rotation is detected by the sensor 104. The rotate carriage will then be rotated at a slower speed until the position sensor determines that the carriage has reached its home position. At this point the brake is engaged and the clutch is released to stop the carriage in its home position.

Next, the elevator carriage is lowered to place the containers back atop the conveyor. The clamps then are opened to release the containers which remain in place on the conveyor because of the gate 87. The elevator carriage is then raised to clear the grip assembly for free passage of the containers out of the rotary mixer when the gate 87 is opened. As the then mixed containers are moved out of the rotary mixer by the conveyor the gate 86 may be opened to allow the next batch of containers to be advanced into the clamp area where they are held in placed by the gate 87 which is closed after being cleared by the last container of the prior batch.

To avoid interference between the gate 87 when the containers are being raised and lowered, the gate 87 may be opened prior to the containers being lifted from the conveyor but after they have been gripped by the clamp. Later, the gate may be closed after the containers have been redeposited on the conveyor but before the clamp is opened.

The rotary mixer may be modified to change the mixing action imparted to the containers. Instead of simply rotating the containers about a stationary horizontal axis the containers may intermittently or simultaneously be subjected to transverse oscillating movement and more particularly to vertical oscillating movement obtained by raising and lowering the elevator carriage during rotation of the rotate frame and clamp assembly. Also, the rotate frame and clamp assembly may be subjected to intermittent and/or oscillatory rotation through less than 360° such as by employing an eccentric arm and crank assembly in place of the drive shaft and gear box.

The linear oscillation of the elevator carriage may be in phase or out of phase with rotation of the rotate frame and clamp assembly to provide for a variety of different types of motion.

The conveyor may be a through conveyor. The illustrated embodiment of rotary mixer according to the invention lends itself to use on existing conveyor lines simply by having the rotary mixer straddle the through conveyor at the desired location in the production line.

The main frame preferably has side guards mounted thereto to protect against the possibility of a container being accidently thrown outside of the confines of the main frame. The side guard may be made of a suitable transparent material such as Lexan and the side guard may be hinged or otherwise mounted for providing quick access to the interior of the rotary mixer. Preferably a pressure switch is provided to shut down the rotary mixer should fluid pressure drop to low.

Although the invention has been shown and described with respect to a preferred embodiment, equivalent alternations and modifications will occur to others skilled in the art upon the reading and understanding of the specification. The present invention includes all such equivalent alterations and modifications, and is limited only by the scope of the following claims.

What is claimed is:

1. A rotary mixer for rotating a plurality of containers to effect mixing of the contents thereof, the containers being fed to and from the rotary mixer by a conveyor, the rotary mixer comprising a clamp including opposed clamp jaws relatively moveable towards one another simultaneously to clamp therebetween a plurality of containers and away from one another to release the containers, and clamp actuator means for effecting such relative movement of said clamp jaws to open and close said clamp; means for moving said clamp relative to the conveyor transversely in relation to a rotate axis to locate the containers clamped between said clamp jaws clear of the conveyor; and means for rotating said clamp about said rotate axis with the containers clamped between said clamp jaws and located clear of the conveyor.

2. A rotary mixer as set forth in claim 1, comprising a main frame, and said means for moving including an elevator carriage mounted to said main frame for vertical movement and means for vertically raising and lowering said elevator frame.

3. A rotary mixer as set forth in claim 2, wherein said clamp includes a rotate frame rotatably carried by said elevator carriage and said opposed clamp jaws are mounted to said rotate frame for relative movement towards and away from one another.

4. A rotary mixer as set forth in claim 3, wherein said clamp actuator means includes at least one piston-cylinder assembly connected between said clamp jaws and said rotate frame.

5. A rotary mixer as set forth in claim 4, wherein said clamp jaws are elongated in a direction parallel to said rotate axis.

6. A rotary mixer as set forth in claim 2, wherein said means for vertically moving said elevator carriage operates to vertically oscillate said elevator carriage during rotation of said clamp.

7. A rotary mixer as set forth in claim 1, wherein said clamp jaws are elongated in a direction parallel to said rotate axis for clamping therebetween a row of containers.

8. A method for simultaneously rotating a plurality of containers to effect mixing of the contents thereof, comprising the steps of positioning opposed clamp jaws at respective sides of a plurality of containers at a pick-up area along a conveyor; closing the clamp jaws simultaneously to clamp therebetween the plurality of containers; moving the closed clamp jaws away from the conveyor so that the containers are clear of the conveyor; rotating the clamp jaws about a rotate axis to rotate the containers clamped therebetween; and then returning the containers to the conveyor and opening the clamp jaws to release the containers.

9. A method as set forth in claim 8, comprising the step of positioning the containers in a row at the pick-up area along the conveyor, and wherein said closing step includes clamping the row of containers between the clamp jaws, and the rotating step includes rotating the containers about a rotate axis parallel to the row of containers.

10. A method as set forth in claim 9, wherein a row of containers is automatically fed by the conveyor to the pick-up area.

11. A method as set forth in claim 8, wherein said moving step includes raising the closed clamp jaws to elevate the containers above and clear of the conveyor.

12. A rotary mixer and conveyor system for rotating a plurality of containers to effect mixing of the contents thereof, said system comprising a conveyor and a rotary mixer; said rotary mixer comprising a clamp including opposed clamp jaws relatively moveable towards one another simultaneously to clamp therebetween a plurality of containers located at a pick-up area along said conveyor and away from one another to release the containers, and clamp actuator means for effecting such relative movement of said clamp jaws to open and close said clamp; means for moving said clamp relative to said conveyor transversely in relation to a rotate axis to locate the containers clamped between said clamp jaws clear of said conveyor; and means for rotating said clamp about said rotate axis with the containers clamped between said clamp jaws.

13. A system as set forth in claim 12, comprising a main frame, and said means for moving including an elevator carriage mounted to said main frame for vertical movement and means for vertically raising and lowering said elevator frame.

14. A system as set forth in claim 13, wherein said main frame includes a pair of legs straddling said conveyor.

15. A system as set forth in claim 13, wherein said clamp includes a rotate frame rotatably carried by said elevator carriage and said opposed clamp jaws are mounted to said rotate frame for relative movement towards and away from one another.

16. A system as set forth in claim 15, wherein said clamp actuator means includes at least one piston-cylinder assembly connected between said clamp jaws and said rotate frame.

17. A system as set forth in claim 16, wherein said clamp jaws are elongated in a direction parallel to said rotate axis.

18. A system as set forth in claim 12, wherein said clamp jaws are elongated in a direction parallel to said rotate axis for clamping therebetween a row of containers.

19. A system as set forth in claim 12, including means for automatically feeding a row of containers to said pick-up area along said conveyor, and wherein said clamp jaws are operable to clamp the row of containers therebetween.

20. A system as set forth in claim 19, including means for automatically feeding the row of containers out of said rotary mixer after the containers have been deposited on said conveyor by said clamp.

* * * * *